United States Patent [19]

Pritulsky

[11] Patent Number: 4,952,170

[45] Date of Patent: Aug. 28, 1990

[54] SHUNTED CONNECTOR ASSEMBLY AND INTERDIGITATED SHUNT ASSEMBLY THEREFOR

[75] Inventor: James Pritulsky, Hummelstown, Pa.

[73] Assignee: AMP Incorporated, Harrisburg, Pa.

[21] Appl. No.: 314,621

[22] Filed: Feb. 23, 1989

[51] Int. Cl.[5] ..... H01R 31/08

[52] U.S. Cl. ..... 439/509; 439/507; 439/513

[58] Field of Search ..... 439/189, 386, 507–514, 439/142, 147, 148, 188

[56] References Cited

U.S. PATENT DOCUMENTS

| | | | |
|---|---|---|---|
| 3,903,385 | 9/1975 | Moyer et al. | 200/51.1 |
| 4,070,557 | 1/1978 | Ostapovitch | 200/51.1 |
| 4,179,173 | 12/1979 | Rise, III | 339/19 |
| 4,501,459 | 2/1985 | Chandler et al. | 339/48 |
| 4,552,423 | 11/1985 | Swengel, Jr. | 339/19 |
| 4,602,833 | 7/1986 | Grabbe et al. | 439/513 X |
| 4,633,048 | 12/1986 | Komatsu | 200/51.1 |

FOREIGN PATENT DOCUMENTS

| | | | |
|---|---|---|---|
| 0158531 | 10/1985 | European Pat. Off. . | |
| 0219304 | 4/1987 | European Pat. Off. . | |
| 2025711 | 7/1978 | United Kingdom | 439/188 |

*Primary Examiner*—Steven C. Bishop
*Attorney, Agent, or Firm*—David L. Smith

[57] ABSTRACT

A shunt assembly (20) adapted to be secured on a connector (22) or a shunt connector assembly (24) where the electrical connector (22) has a housing (26) with spaced contacts (62) secured therein. The contacts (62) have exposed contact portions along a side wall (32) of housing (26). A contact support lever (152) is pivotally mounted to housing (26). The contact support lever (152) has an inner surface (250) having interdigitated channels (254,256,258,260,262,264) has a pair of shunt contacts (156,158) received and secured therein for engaging a surface of the exposed contact portions of preselected ones of the spaced contacts (62). The contact support lever (152) is rotatable through a limited arc from a first position with the shunt contacts (156,158) engaging the spaced contacts (62), to a second position where the shunt contacts (156,158) are electrically isolated from the spaced contacts 62. A spring (154) provides a constant bias on the contact support lever (152) to bias the contact support lever (152) toward the first position.

14 Claims, 6 Drawing Sheets

SHUNTED CONNECTOR ASSEMBLY AND INTERDIGITATED SHUNT ASSEMBLY THEREFOR

BACKGROUND OF THE INVENTION

This invention relates to electrically shunting contacts in an unmated electrical connector, and in particular to a shunt assembly for use with an electrical connector or an electrical connector incorporating the shunt assembly wherein, upon unmating the connector from a mating connector, the shunt is biased to engage contacts of the unmated connector to electrically common predetermined ones of the contacts.

When a connector having a cable extending to a computer system is disconnected from a peripheral device, predetermined ones of the conductors of the disconnected cable must be electrically commoned within a limited time of being disconnected so as to cause the computer system not to power down. This has traditionally been achieved by providing a complementary connector, mounted on a printed circuit board, for mating with the disconnected connector upon being disconnected from the peripheral device. Traces on the circuit board electrically common the appropriate contacts of the printed circuit board connector and thus the corresponding cable conductors. As computers become faster and faster, the available time to achieve electrical commoning of the conductors of the disconnected cable has been significantly decreased.

It would be desirable to have a shunt assembly to automatically provide the electrical commoning of the appropriate conductors of a cable upon unmating of a connector from a peripheral device.

SUMMARY OF THE INVENTION

In accordance with the present invention, a shunt connector assembly provides an electrical connector having a housing with spaced contacts therein, the contacts have exposed contact portions along a side wall of the housing. Contact support means are pivotally mounted to the housing and have at least one shunt contact secured therein. The shunt contact has a pair of cantilever arms interconnected by a bridging member. The cantilever arms provide means for engaging a surface of the exposed contact portions of two of the spaced contacts. The contact support member is movable through a limited arc from a first position, with the shunt contact engaging the two spaced contacts, to a second position where the shunt contact is electrically isolated from the two spaced contacts. A spring engaging the contact support member provides bias means for biasing the contact support means toward the first position.

DESCRIPTION OF THE PREFERRED EMBODIMENT

Figure 1:
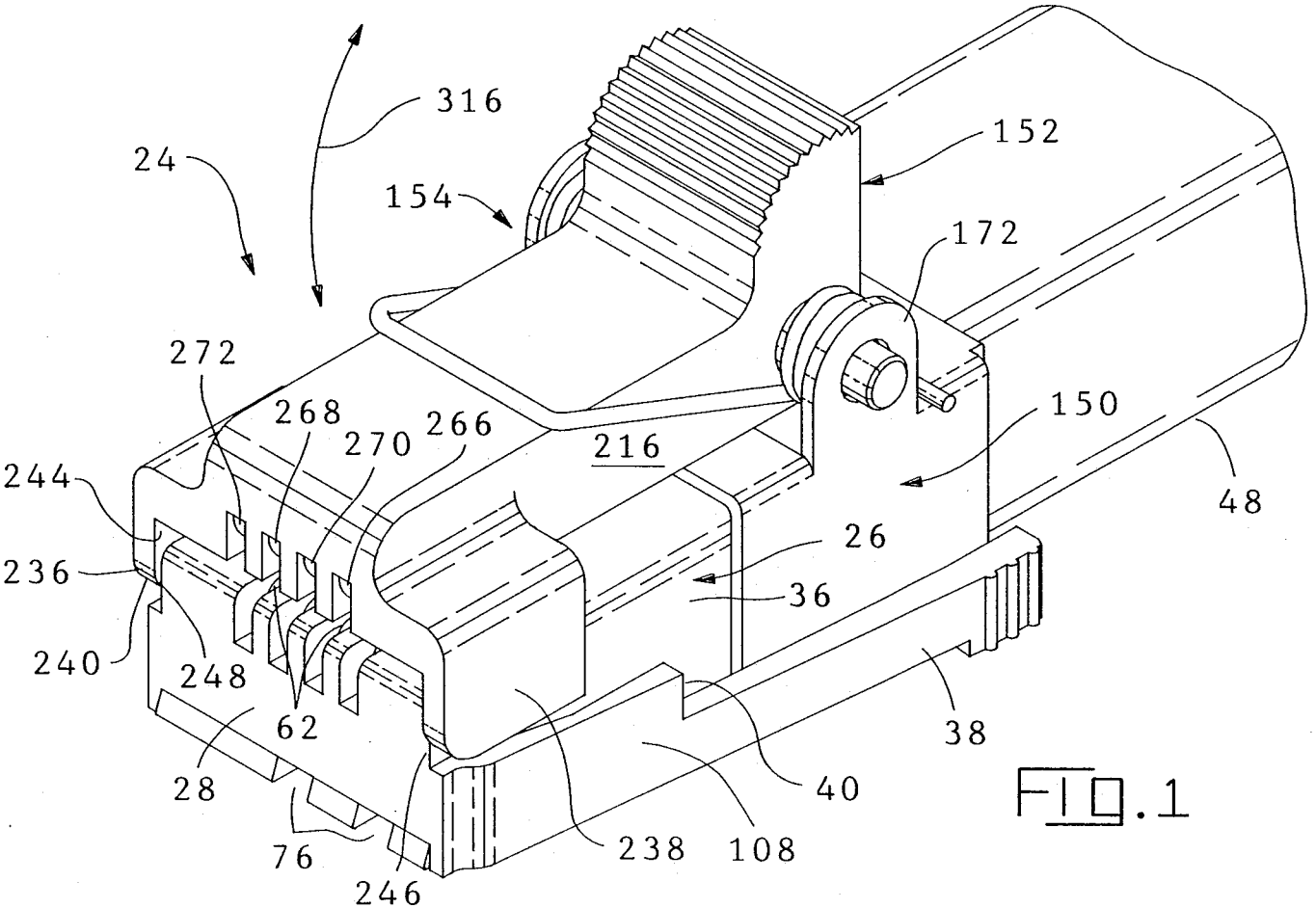
FIG. 1 is a perspective view of a shunt assembly in accordance with the present invention secured to a connector resulting in a shunted connector assembly in accordance with the present invention.

A shunt assembly 20 in accordance with the present invention is shown in FIG. 1 secured to a plug connector 22 resulting in shunted connector assembly 24. Plug 22 is in accordance with the teaching of U.S. Pat. No. 3,860,316, the disclosure of which is hereby incorporated by reference. Plug connector 22 comprises an insulative housing 26 having a mating end 28, a rearward end 30, upper and lower housing side walls 32,34, and oppositely facing housing end walls 36. Latch arms 38 extend from the housing end walls 36 and have rearwardly facing shoulders 40 which engage shoulders 42 in the receptacle 44 when plug 22 is mated with receptacle 44.

A cable receiving opening 46 extends into rearward end 30 having cable 48 inserted therein. Conductors 50 of cable 48 extend into a reduced cross-section forward portion 52 of opening 46, cable 48 being retained by an integral strain relief clamp 54 formed in recess 56 of upper housing side wall 32. Conductors 50 being retained by conductor strain relief means 58 in recess 60 in accordance with the teaching of U.S. Pat. No. 3,860,316.

Contacts 62 are received in recesses 64 which extend inwardly from mating end 28 and inwardly from upper side wall 32. Contacts 62 have insulation piercing portions 66 which extend through apertures 68 and electrically engage the individual conductors 50 of cable 48. Contacts 62 engage with cantilever spring receptacle contacts 70 in receptacle 44 when plug 22 is mated with receptacle 44. Cantilever spring receptacle contacts 70 complete a plurality of circuits to printed circuit board 72 within panel 74.

Plug 22 may have key ways 76 extending inwardly from mating end 28 along lower side wall 34 to receive complementary keys 78 integral with receptacle 44. Keying systems for this type of connector are disclosed in U.S. Pat. Nos. 4,457,575, and 4,781,626, the disclosures of which are hereby incorporated by reference.

Receptacle 44 is typically shielded at 80 and is of type taught by U.S. Pat. No. 4,221,458, the disclosure of which is hereby incorporated by reference. Typically, receptacle 44 has a one piece molded insulating housing 82 having a mating end 84 and a rearward end 86, upper and lower external housing side walls 88 and 90 respectively, and oppositely facing end walls 92. A flange (not shown) may be provided on mating end 84 to overlap and surround aperture 96 in panel 74 through which receptacle 44 is mounted. Receptacle 44 is mounted on printed circuit board 72 and has known board locks 96 extending from lower side wall 90 which secure receptacle 44 to printed circuit board 72.

A plug receiving cavity 98 extends inwardly from the mating end 84 and receives the forward portion 100 of plug 22 as the plug and receptacle are mated. Cavity 98 has upper and lower side walls 102,104 and opposed end walls 106. The forward portion 100 of plug 22 extends from mating end 28 a substantial distance towards the rearward end 86. Leading portions 108 of latch arms 38 are received in cavity 98 so that shoulders 40 of latch arms 38 will pass over and engage shoulders 42 in end walls 106 to latchingly retain plug 22 in cavity 98.

Cantilever spring receptacle contacts 70 are arranged in side-by-side relationship in a row which extends between end walls 106. Contacts 70 in receptacle 44 correspond in number and spacing to contacts 62 in plug 22. Each cantilever spring receptacle contact 70 has a post portion 112 which extends beyond housing side wall 90 to engage and be soldered 114 to a conductive trace 116 on a side 118 of circuit board 72. Each contact 70 also has an intermediate portion 120 which is received in a recess 122 extending inwardly from the lower side wall 90 and a contact spring portion 124 which extends obliquely into cavity 98 with reverse bend 126 therebetween recessed from mating end 84. The free end 128 of contact portion 124 extends through a recess formed by spaced-apart barrier walls 130 at the inner end of cavity 98 and into a more central region of the cavity. Barrier walls 130 define recesses 122 therebetween to position contacts 70 and prevent adjacent contacts 70 from engaging each other. Contact portions 124 wipingly engage surface 132 of contacts 62 upon insertion of plug 22 into cavity 98, that is, upon mating of plug 22 and receptacle 44.

Figure 2:
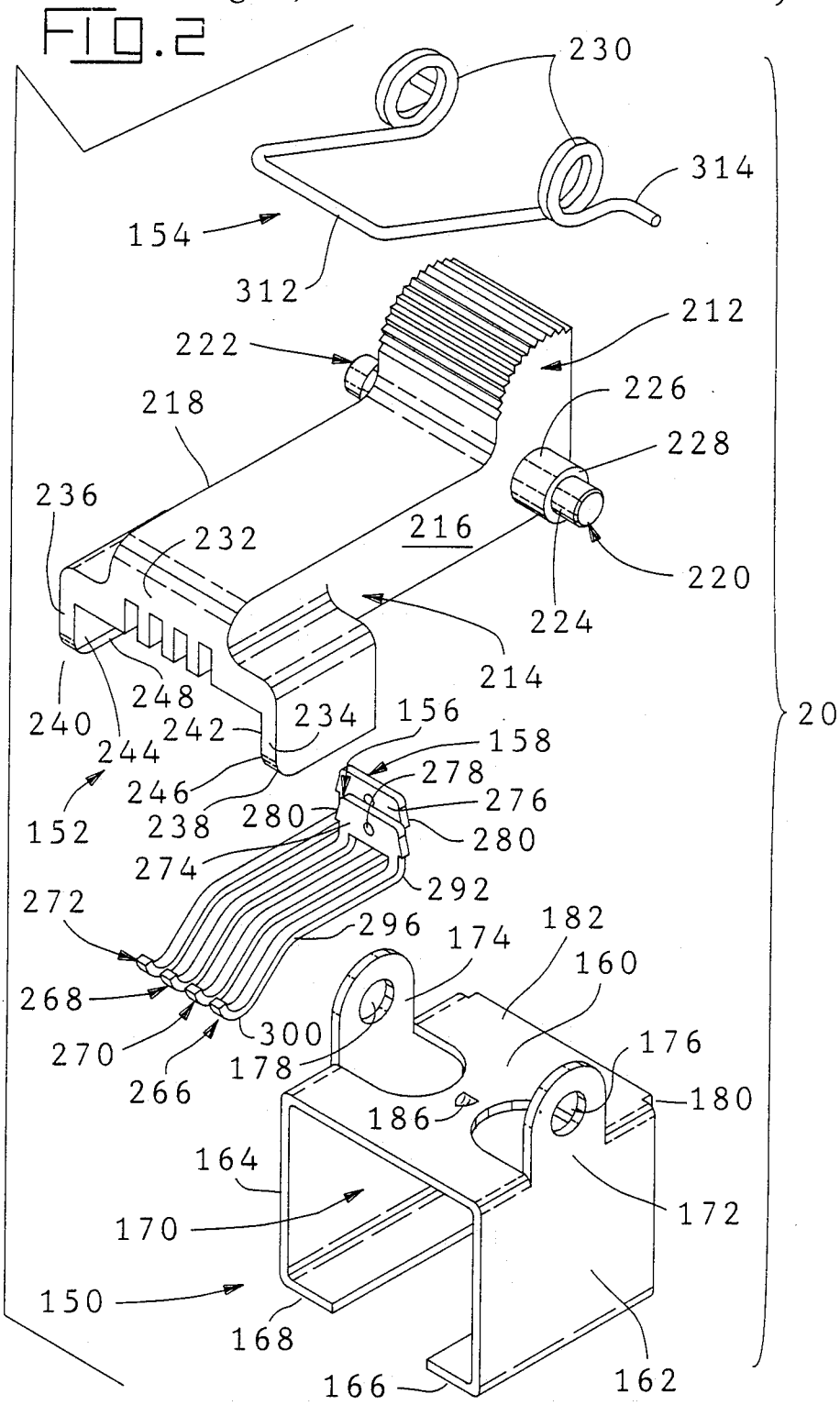
FIG. 2 is an exploded perspective view of the shunt assembly shown in FIG. 1.

As best seen in the exploded perspective view of FIG. 2, shunt assembly 20 is comprised of bracket 150, shunt contact holding lever 152, spring 154 and contacts 156,158.

Bracket 150 in the preferred embodiment is a stamped and formed, channel-shaped member but could equally be a molded plastic member providing the same function. Bracket 150 includes top wall 160, the inner surface of which engages upper housing side wall 32 of plug 22 when bracket 150 is mounted thereon. Opposed side walls 162,164 depend from opposed lateral edges of top wall 160, extending normally thereof. The inner surface of side walls 162,164 engage housing end walls 36 of plug 22 when bracket 150 is mounted thereon. Bottom walls 166,168 extend respectively from side walls 162,164 toward the opposite side wall, the inner surfaces of which engage lower housing side wall 34 of plug 22 when bracket 150 is mounted thereon. Walls 160,162,164,166,168 define therein a channel 170 for receiving plug 22.

Lever mounting ears 172,174 are sheared from material that would otherwise form another part of bracket 150 such as side walls 162 and 164 and formed upward, or top wall 160 as in the preferred embodiment and are formed to be substantially parallel to each other as well as substantially normal to top wall 160. Lever mounting ears 172,174 have coaxially aligned circular lever mounting apertures 176,178 therein, respectively. Lever mounting ears 172,174 thus provide a pair of spaced lever mounting means.

Figure 3:
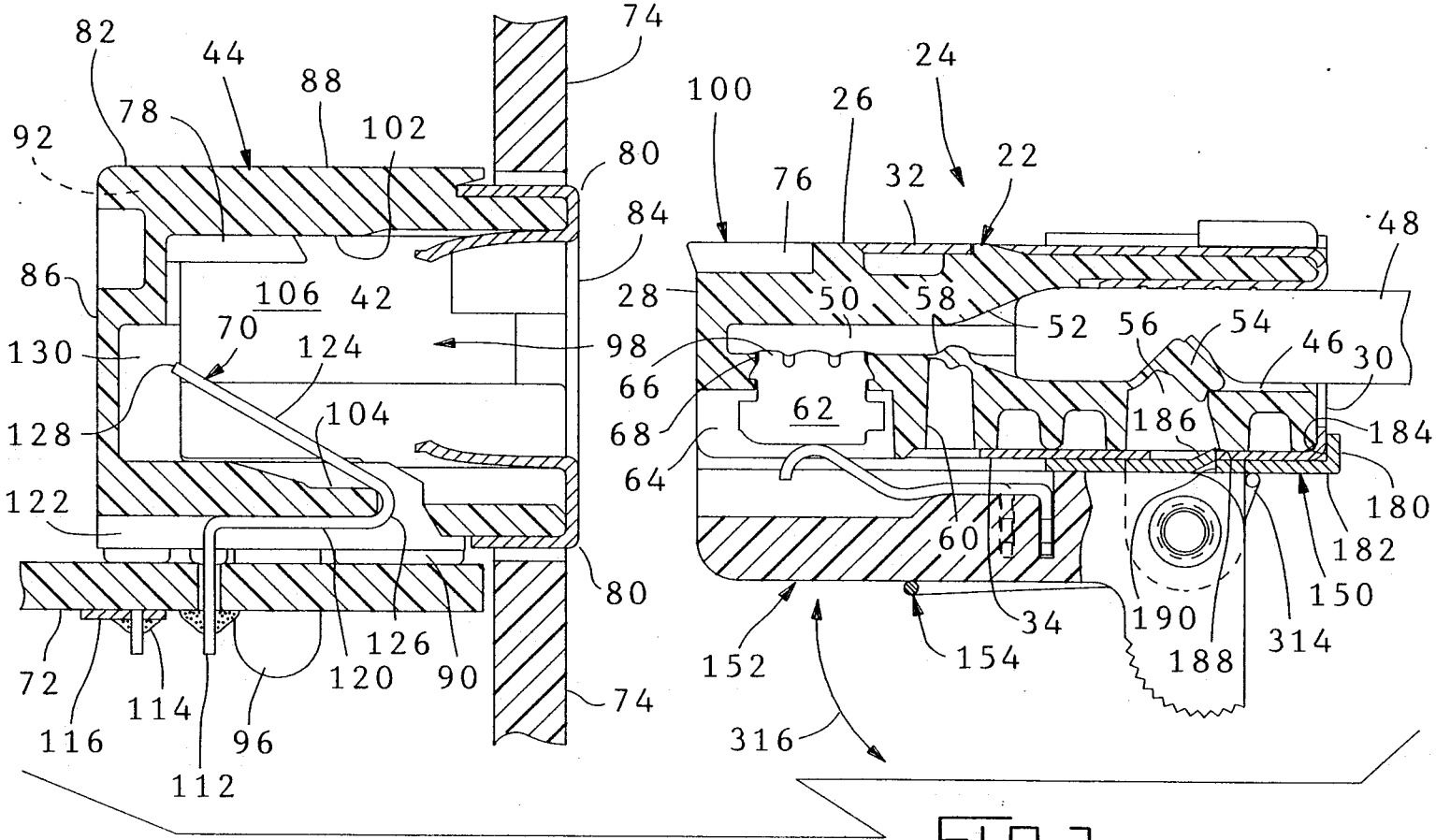
FIG. 3 is a cross-sectional view of a plug and receptacle connector, incorporating the present invention, positioned to be mated.

Flange 180 depends from rearward edge 182 of top wall 160, normal to top wall 160, partially closing off channel 170. The inner surface 184 of flange 180 functions as a stop shoulder engaging rearward end 30 of plug 22 to position bracket 150 on plug 22 as best seen in FIG. 3. Spaced forwardly along channel 170 from flange 180 is detent 186. Detent 186 is in the form of a resilient protrusion formed in top wall 160 projecting obliquely inwardly into channel 170 from the inner surface of top wall 160 to define a stop shoulder 188. Stop shoulder 188 faces flange 180 and is received against a wall 190 of recess 56. Flange 180 and detent 186 thus cooperate with top wall 160, side walls 162,164 and bottom walls 166,168 to provide means for securing bracket 150, and hence shunt assembly 20, to plug 22.

Figure 5:
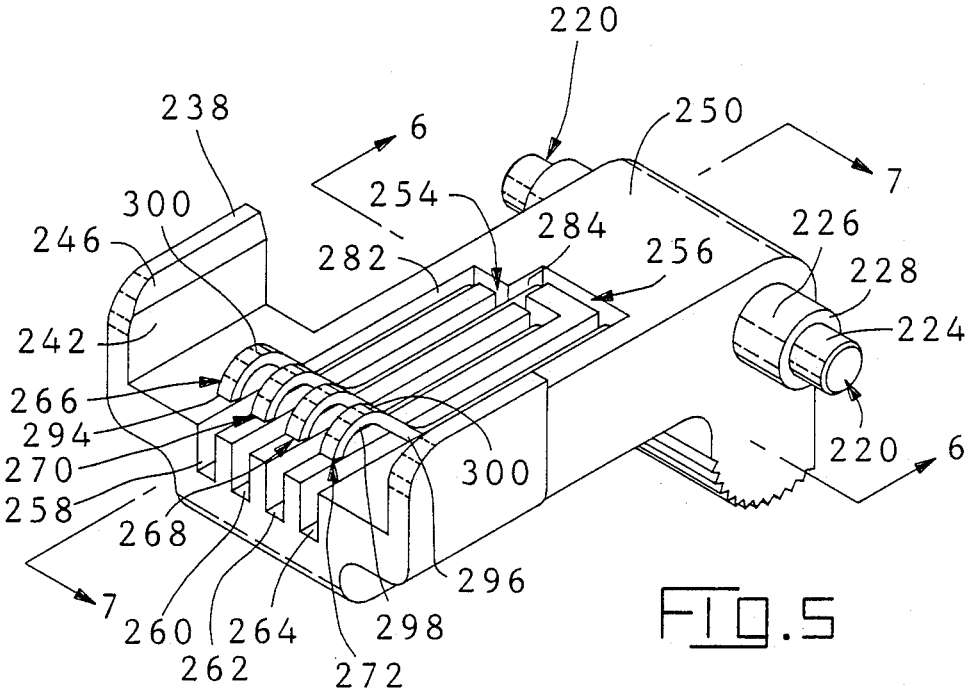
FIG. 5 is a view of the inner surface of the shunt contact holding lever.
Figure 6:
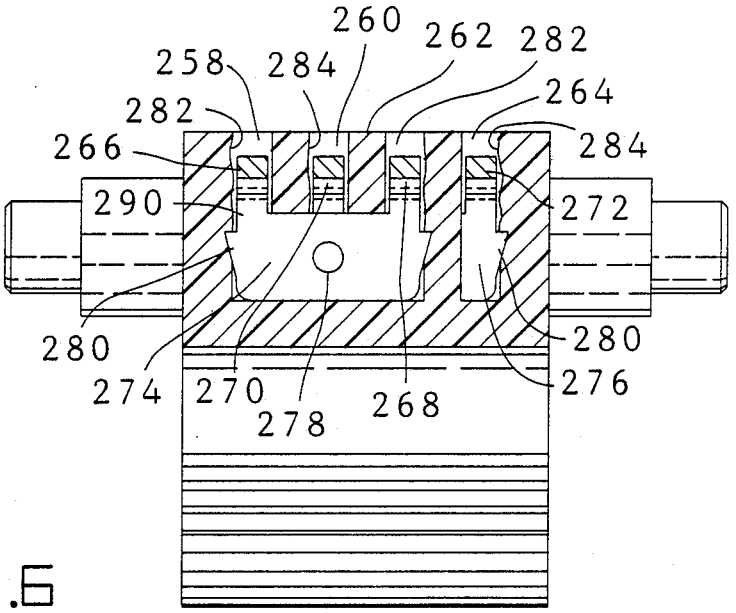
FIG. 6 is an isometric cross-section of the shunt contact holding lever taken along the lines 6—6 of FIG. 5.

As best seen in FIGS. 2, 5 and 6, shunt contact holding lever 152 is molded of insulative material, typically a thermoplastic, and has a generally "L" shaped body 210 defining shorter leg 212, longer leg 214 and opposed side walls 216 and 218. Extending laterally from side walls 216,218, proximate the intersection of legs 212,214 are cylindrical dual diameter, stepped pivot protrusions 220,222 having outer pivot 224 and inner pivot 226.

Outer pivot 224 has a smaller outer diameter than inner pivot 226, with a difference in diameters defining annular surface 228. Pivots 224 and 226 on each pivot protrusion 220,222 are coaxial as well as being coaxial with the pivots on the other pivot protrusion. Outer pivots 224 are sized to be received in lever mounting apertures 172,174 to permit shunt contact holding lever 152 to be rotated through a limited arc about pivot protrusions 220,222. Annular surfaces 228 are spaced apart substantially as the inner surfaces of lever mounting ears 172,174. Thus, during assembly of shunt contact holding lever 152 to bracket 150, mounting ears 176,178 are resiliently deflected outwardly to position outer pivots 224 in lever mounting apertures 176,178 and thereafter resile inwardly to a substantially unbiased position. Alternatively, mounting ears 172,174 could have a slot terminating in a pivot seating detent.

Inner pivot 226 has an outside diameter sized to be received within coil 230 of spring 154. Coil 230 and thus spring 154 pivot around pivot 226.

Shunt contact holding lever 152 has a free end 232 on longer leg 214, remote from pivot protrusions 220,222 where shunt contact holding leVer 152 is rotatably mounted to bracket 150. Extending from side walls 216,218 at free end 232 are flanges 234,236, integral at one end with leg 214 and extending to respective free ends 238,240. Flanges 234,236 form a "U" shaped channel structure, with leg 214 as the web and having facing inner walls 242,244 which are chamfered 246,248 along the intersection with respective free ends.

As best seen in FIGS. 3, 5, 6 and 7, inner surface 250 has transverse channels 254,256 and axial channels 258,260,262,264 recessed from the inner surface for receiving contacts 156 and 158. Channels 258,260,262,264 are spaced across inner surface 250 between side walls 216 and 218 to correspond in position and number to plug contacts 62. Axial channels 258 and 262 intersect transverse channel 256 and receive contact 156 therein with cantilever arms 266 and 268 received respectively therein. Axial channels 260,264 intersect transverse channel 254 and receive contact 158 therein with cantilever arms 270,272 received respectively therein.

Contacts 156 and 158 are substantially identical, but for the length of their respective cantilever beams. Each contact 156,158 has a bridging body member 274,276 from which the respective cantilever arms depend. Each bridging member 274,276 has a stabling protrusion 278 therein and a barb 280 extending from opposed end walls for plowing through the end walls 282,284 of channels 254,256 to secure contacts 156,158 respectively therein with bridging members 274,276 at substantially the same depth from surface 250. Stabling protrusion 278 is received in channels 254,256 engaging side walls 286,288 thereof in an interference fit to stabilize contacts 156,158 in channels 254,256. Cantilever arms 266,268,270,272 depend from respective bridging members 274,276 by extending in the plane of the bridging member forming extension 290, thence extending normal thereto at bend 292. Contacts 156 and 158 are thus a pair of interdigitated shunt contacts that provide electrical commoning of spaced contacts 62 that are not necessarily adjacent to each other, may have other spaced contacts between any two spaced contacts that are being electrically commoned, and may even have a spaced contact between the cantilever arms of a first shunt contact that are being electrically commoned by cantilever arms of a second shunt contact with a spaced contact beyond the cantilever arms of the first shunt contact.

Axial channels 258 and 262, along with transverse channel 254, when taken together with axial channels 260 and 264 and transverse channel 256 provide interdigitated U-shaped channels for receiving interdigitated contacts 156,158.

Cantilever arms 266,268,270,272 have, near the free ends 294 thereof, a first bend 296 which results in the cantilever arms extending out of axial channels and a second, reverse bend 298 between the first bend and the free ends 294, providing arcuate portions 300 to engage respective plug contacts 62. In the preferred embodiment, free ends 294 extend back into respective axial channels to assist in maintaining the position of arcuate portions 300 to correspond to the position of respective plug contacts 62.

As best seen in FIG. 6, cantilever arm 270 passes over bridging member 274 without making electrical engagement therewith due to extension 290 positioning cantilever arm 270 spaced from bridging member 274. Positioning bridging members 274,276 at different depths in respective transverse channels or forming cantilever arm 270 differently would achieve the same function.

Coils 230 of spring 154 are received over inner pivots 226 with transverse member 312 extending across and engaging leg 214 and with tails 314 engaging top wall 160 of bracket 150. Coils 230 bias shunt contact holding lever 152 such that contacts 156,158 and more specifically, arcuate portions 300 of cantilever arms 266,268,270,272, engage respective contacts 62 of plug 22 when plug 22 is in a first position shown in FIG. 3.

Figure 7:
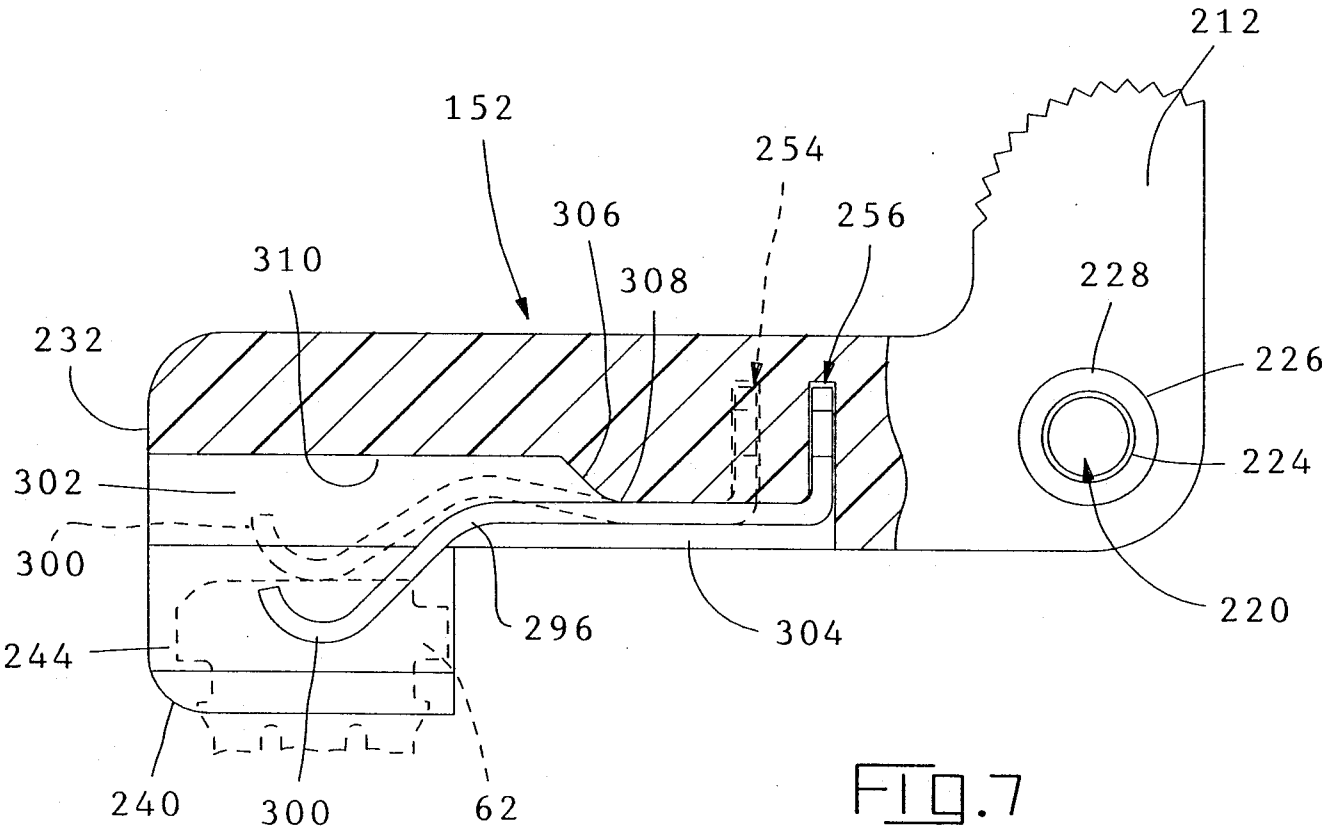
FIG. 7 is a side view, partially sectioned, of the shunt contact holding lever.

As best seen in FIG. 7, cantilever arms 266,268,270,272 are deflected into their respective axial channel upon engaging a plug contact 62. To assure that cantilever arm 270 does not engage bridging member 274, at least axial channel 260, and typically axial channels 258,262 and 264 as well, have a deeper region 302 near the free end 232, a shallower region 304 in the region of transverse channels 254,256, and a transition region 306 therebetween, defining fulcrum 308 at a location spaced from transverse channel 254 toward free end 232, proximate transition 306. As shunt contact holding lever 152 is rotated toward the first position, the force of spring 154 causes, upon engagement of portions 300 with contacts 62, cantilever arms 266,268,270 and 272 to resiliently deflect or bend into the respective axial channel. The resilient bending is concentrated at fulcrum 308 to prevent cantilever arm 270 from bending near bridging member 276 sufficiently to engage bridging member 274. The cantilever arm may engage bottom 310 of a respective axial channel to provide an antioverstress function When shunt assembly 20 is applied as part of assembling plug 22 to cable 48, shunt assembly 20 is applied to plug connector 22 by sliding bracket 150 over the end of cable 48 prior to terminating conductors of cable 48 to plug connector 22. The pivot end of shunt contact holding lever 152 and the flange end of bracket 150 lead shunt assembly 20 on to cable 48. Cable 48 is slid into cable receiving cavity 46 with conductors 50 continuing into reduced cross-section forward portion 52. Contacts 62 are terminated to conductors 50 of cable 48 and strain relief means 54 and 58 are actuated, thereby assembling plug connector 22 to cable 48. Alternatively, shunt assembly 20 may be applied to a plug previously terminated to a cable 48 by passing cable 48 through the gap between bottom walls 166,168.

Shunt assembly 20 is then slid along cable 48 toward plug connector 20 until bracket 150 passes partially over plug connector 22 and plug connector 20 is partially received within channel 170 of bracket 150. Detent 186 rides up the edge of rearward end 30, thence along upper housing side wall 32. Bracket 150 and thus shunt assembly is positioned on plug connector 22 by the inner surface 184 of flange 180 engaging rearward end 30. Simultaneously, the trailing edge of detent 186 resiles into recess 56, engaging forward facing wall 190. Shunt assembly 20 is thus positioned and secured on plug connector 22.

With bracket 150, shunt contact holding lever 152, spring 154 and contacts 156,158 assembled to the shunt assembly 20 and further with shunt assembly 20 assembled to plug 22 to form shunted connector assembly 24, shunt contact holding lever 152 can pivot through a limited arc, illustrated by arrow 316, between first and second positions. Shunt contact holding lever is shown in the first position in FIG. 3 wherein spring 154 has biased the free end of shunt contact holding lever 152 toward housing 26 of plug 22 such that cantilever arms 266,268,270 and 272 engage respective predetermined ones of plug contacts 62 thereby electrically commoning the contacts 62 engaged by cantilever arms 266 and 268 through bridging member 274, as well as electrically commoning the contacts 62 engaged by cantilever arms 270 and 272 through bridging member 276. In this first position, spring 154 continues to bias the free end of shunt contact holding lever 152 toward housing 26, and it is this bias that provides the force that causes cantilever arms 266,268,270 and 272 to deflect, as illustrated in FIG. 7 and to maintain electrical engagement between the cantilever arms and contacts 62.

As evident from FIG. 3, if an attempt were made to mate plug 22 of shunted connector assembly 24 and receptacle 44 with shunt contact holding lever 52 in the first position, stubbing would occur. Thus, prior to mating plug 22 of shunted connector assembly 24 with receptacle 44, shunt contact holding lever must be rotated such that free end 232 moves away from housing 26 of plug 22 (counterclockwise in FIG. 3) as indicated by arrow 316.

Shorter leg 212 can be thumb actuated to rotate shunt contact holding lever 152 through a limited arc to break the electrical engagement between contacts 156,158 and respective plug contacts 62. As shunt contact holding lever 152 is rotated such that free end 232 moves away from housing 26 of plug 22, arcuate portions 300 of cantilever arms 266, 268, 270 and 272 continue to engage contacts 62 until fully resiled to their unbiased position, whereupon continued rotation of shunt contact holding lever in the same direction causes engagement between cantilever arms 266, 268, 270 and 272 and respective contacts 62 to terminate, thereby causing the electrical commoning to cease. This defines the minimum rotation of shunt contact holding lever 152 to achieve the second position. As shunt contact holding lever 152 is rotated such that the free end 232 moves away from housing 26, spring 154 becomes even more biased.

Figure 4:
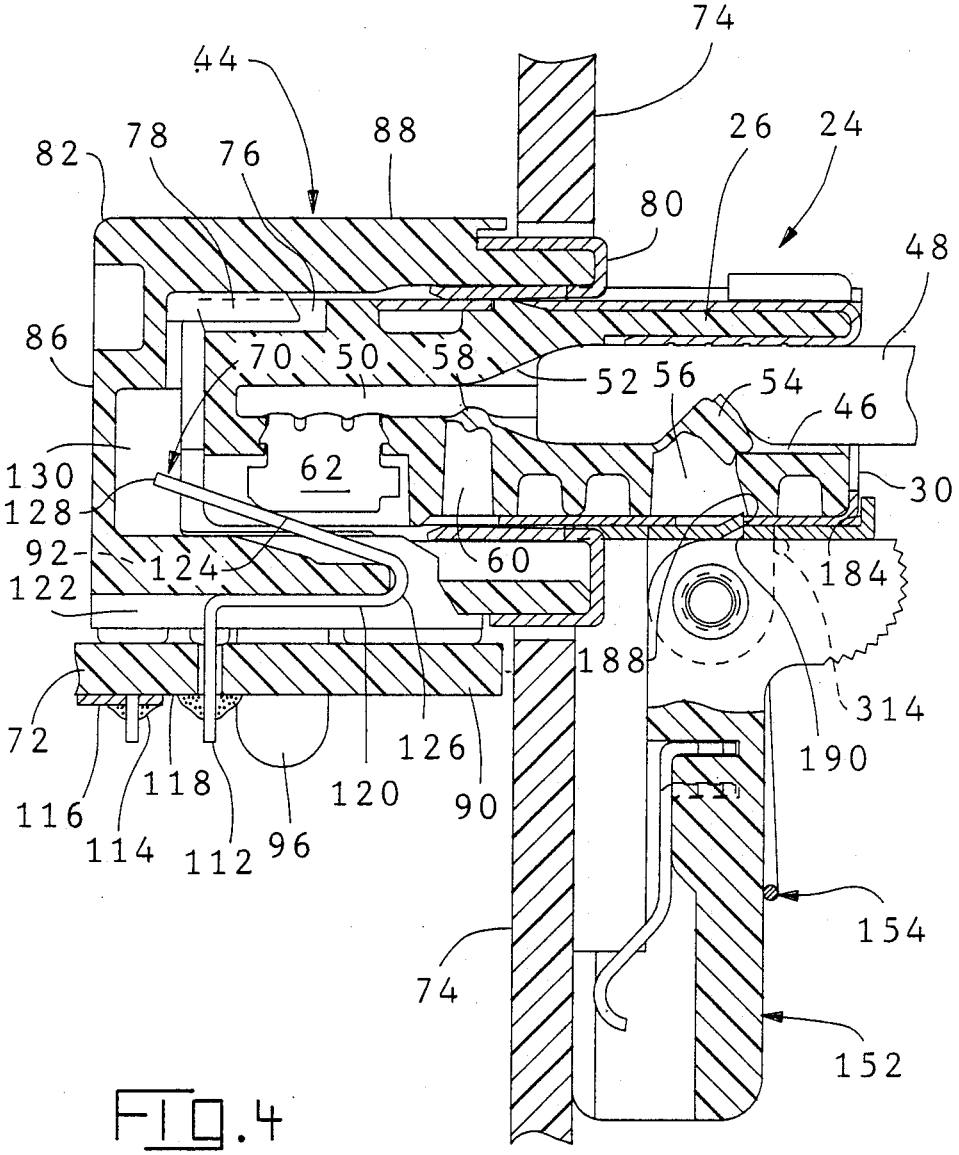
FIG. 4 is a side view, partially cut away, of a shunted connector assembly mated with a receptacle connector.

In a typical application where plug connector 22 of shunted connector assembly 24 extends through an aperture in a panel to mate with a receptacle 44 within the panel, shunt contact holding lever 152 will be rotated more than minimally required to achieve the second position of breaking the engagement between cantilever arms and respective contacts 62. As shown in FIG. 4, shunt contact holding lever 152 can be maintained in the second position with free ends 238,240 of flanges 234,236 engaging panel 74, biased thereagainst by spring 154, and protecting contacts 156 and 158 by preventing them from engaging panel 74.

While shunt contact holding lever 152 is biased by spring 154 in the first position (shown in FIG. 3), it is even more biased in the second position (shown in FIG. 4). Thus, upon unmating of plug 22 of shunted connector assembly 24 from receptacle 44, spring 154 causes the free end 232 of shunt contact holding lever 152 to rotate toward housing 26, pivoting about protrusions 220,222 until arcuate portions of contacts 156 and 158 engage respective contacts 62 of plug 22 thereby providing electrical commoning as described above. As the free end 232 of shunt contact holding lever 152 moves toward housing 26, chamfered surfaces 246,268 assist in positioning lever 152 relative to housing 26 such that inner walls 242,244 slide past housing sidewalls 36 to align cantilever arms 266, 268, 270 and 272 with respective contacts 62. The bias of spring 154 causes free ends 238,240 of flanges 234,236 to engage side 252 of latch arms 38, and seat thereagainst. Rotation of shunt contact holding lever 152 is inherent upon unmating plug 22 from receptacle 44 due to the bias provided by spring 154. Automatic shunting or electrical commoning is thus automatically achieved upon unmating plug 22.

In the example of the preferred embodiment, contact 156 shorts or electrically commons positions 1 and 3 while contact 158 shorts or electrically commons positions 2 and 4. The invention, however, is not limited to a plug connector having four contact elements 62, nor is the invention limited to shorting the contacts of positions 1 to 3 and 2 to 4.

I claim:

1. A shunt connector assembly, comprising:

an electrical connector having a housing with spaced contacts therein, said contacts having exposed contact portions along a side wall of said housing;

contact support means pivotally mounted to said housing, said contact support means having at least one shunt contact secured therein, said shunt contact having means for engaging a surface of the exposed contact portions of two of said spaced contacts, said contact support means moveable through a limited arc from a first position with said shunt contact engaging said two spaced contacts, to a second position where said shunt contact is electrically isolated from said two spaced contacts; and bias means engaging said contact support means for biasing said contact support means toward said first position.

2. A shunt connector assembly as recited in claim 1, wherein the contact support means has a free end, further comprising a pair of flanges depending from opposed side walls proximate said free end, each of said flanges defining an inner wall, said inner walls being spaced substantially the same distance that end walls of said housing are spaced and a free end remote from said contact support means, said inner wall chamfered along said free end, whereby the chamfer assists in laterally positioning the contact support means relative to the housing when said contact support means pivots from the second position to the first position.

3. A shunt connector assembly as recited in claim 1, wherein the surface of the exposed contact portion of said spaced contacts engaged by said shunt contact when said contact support means is in the first position is the surface engaged by contact means of a complementary connector when said shunt connector assembly is mated to the complementary connector.

4. A shunt connector assembly comprising:

an electrical connector having a housing with spaced contacts therein, said contacts having exposed contact portions along a side wall of said housing;

contact support means pivotally mounted to said housing, said contact support means having at least two interdigitated shunt contacts secured thereto, each of said interdigitated contacts having a pair of cantilever arms for engaging a surface of the exposed contact portions of two of said spaced contacts, said contact support means movable through a limited arc from a first position with said shunt contacts each engaging two spaced contacts, to a second position where said shunt contacts are electrically isolated from said respective spaced contacts; and bias means engaging said contact support means for biasing said contact support means toward aid first position.

5. A hunt connector assembly as recited in claim 4, wherein the contact support means defines a free end and has an inner surface, said inner surface facing said housing, said contact support means further comprising:

a first transverse channel recessed from said inner surface and spaced from said free end a first predetermined distance;

first and second axial channels recessed from said inner surface, said first and second axial channels extending from proximate said free end to and intersecting with said first transverse channel;

a second transverse channel recessed from said inner surface, said second transverse channel spaced from said free end a second predetermined distance wherein said second predetermined distance is greater than said first predetermined distance; and third and fourth axial channels recessed from said inner surface, said third and fourth axial channels extending from proximate said free end to and intersecting with said second transverse channel, said third axial channel being positioned between said first and second axial channels, said shunt contacts being received in said channels.

6. A shunt connector assembly as recited in claim 5, wherein each of said shunt contacts comprise a bridging member having means for securing said shunt contacts in said contact support means, and cantilever arms extending from end regions of said bridging member.

7. A shunt connector assembly as recited in claim 6, wherein said cantilever arms extend normally of said bridging member.

8. A shunt connector assembly as recited in claim 4, wherein at least one of said at least two interdigitated shunt contacts is electrically isolated from the other of said at least two interdigitated shunt contacts.

9. A shunt connector assembly as recited in claim 4, wherein a first shunt contact of said at least two interdigitated shunt contacts has portions capable of engaging a first pair of said spaced contacts when said contact support means is in said first position, and wherein a second shunt contact of said at least two interdigitated shunt contacts has portions capable of engaging a second pair of said spaced contacts when said contact support means is in said first position, at least one contact of said second pair of spaced contacts being between said first pair of spaced contacts.

10. A shunt connector assembly as recited in claim 4, further comprising:

said contact support means defines a surface having a transverse channel recessed therefrom, one of said at least two interdigitated shunt contacts having a bridging member receivable in said transverse channel, whereby said one of said at least two interdigitated shunt contacts is electrically isolated from the other of said at least two interdigitated shunt contacts.

11. A shunt connector assembly as recited in claim 10, further comprising securing means on said bridging member for securing said one of said at least two interdigitated shunt contacts to said contact support means.

12. A shunt assembly adapted to be secured on a connector and adapted to shunt exposed portions of contacts of the connector when the connector is unmated, the connector of the type having a housing with spaced contacts therein, the spaced contacts having exposed contact portions along a side wall of the housing, the shunt assembly comprising:

contact support means adapted to be pivotally mounted to the housing, said contact support means having at least one shunt contact secured therein, said shunt contact having means for engaging a surface of the exposed contact portions of two of said spaced contacts, said contact support means moveable through a limited arc from a first position with said shunt contact engaging the two spaced contacts, to a second position where said shunt contact is electrically isolated from the two spaced contacts; and bias means adapted to engage said contact support means to bias said contact support means toward said first position when the shunt assembly is assembled to the connector.

13. A shunt connector assembly, comprising:

an electrical connector having a housing with spaced contacts therein, said contacts having exposed contact portions along a side wall of said housing;

contact support means pivotally mounted to said housing, said contact support means having at least one shunt contact secured therein, aid shunt contact having means for engaging a surface of the exposed contact portions of at least two of said spaced contacts, said contact support means moveable through a limited arc from a first position with said shunt contact engaging said two spaced contact, to a second position where said shunt contact is electrically isolated from said two spaced contacts; and bias means engaging said contact support means for biasing said contact support means toward said first position.

14. A shunt assembly adapted to be secured on a connector and adapted to shunt exposed portions of contacts of the connector when the connector is unmated, the connector of the type having a housing with spaced contacts therein, the spaced contacts having exposed contact portions along a side wall of the housing, the shunt assembly comprising:

contact support means adapted to be pivotally mounted to the housing, said contact support means having at least one shunt contact secured therein, said shunt contact having means for engaging a surface of exposed contact portions of at least two of said spaced contacts, said contact support means moveable through a limited arc from a first position with said shunt contact engaging the at least two spaced contacts, to a second position where said shunt contact is electrically isolated from the at least two spaced contacts; and bias means adapted to engage said contact support means to bias said contact support means toward said first position when the shunt assembly is assembled to the connector.

* * * * *

UNITED STATES PATENT OFFICE

CERTIFICATE OF CORRECTION

Patent No. 4,952,170 Dated August 28, 1990

Inventor(s) James Pritulsky

It is certified that error appears in the above-identified patent and that said Letters Patent is hereby corrected as shown below:

CLAIM 4, Column 8, line 34, "aid" should be --said--

CLAIM 5, Column 8, line 36, "hunt" should be --shunt--

CLAIM 13, Column 10, line 11, "aid" should be --said--

CLAIM 13, Column 10, line 17, "contact" should be --contacts--

Signed and Sealed this

Seventeenth Day of March, 1992

*Attest:*

HARRY F. MANBECK, JR.

*Attesting Officer*

*Commissioner of Patents and Trademarks*